US006183346B1

(12) United States Patent
Gagliardi

(10) Patent No.: US 6,183,346 B1
(45) **Date of Patent: *Feb. 6, 2001**

(54) ABRASIVE ARTICLE WITH EMBOSSED ISOLATION LAYER AND METHODS OF MAKING AND USING

(75) Inventor: John J. Gagliardi, Hudson, WI (US)

(73) Assignee: 3M Innovative Properties company, St. Paul, MN (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/129,823

(22) Filed: Aug. 5, 1998

(51) Int. Cl.[7] ..... B24D 3/00

(52) U.S. Cl. ..... 451/28; 51/295; 51/306

(58) Field of Search ..... 451/28, 46, 526; 51/295, 297, 306

(56) References Cited

U.S. PATENT DOCUMENTS

| | | | | |
|---|---|---|---|---|
| 2,347,244 | | 4/1944 | Colt et al. | 51/294 |
| 2,542,058 | | 2/1951 | Riedesel | 51/185 |
| 3,090,061 | | 5/1963 | Charvat | 15/159 |
| 3,134,122 | | 5/1964 | Charvat | 15/179 |
| 3,246,430 | | 4/1966 | Hurst | 51/402 |
| 3,301,741 | | 1/1967 | Hendrickson et al. | 161/119 |
| 3,562,968 | | 2/1971 | Johnson et al. | 51/389 |
| 3,918,217 | | 11/1975 | Oliver | 51/295 |
| 3,985,521 | | 10/1976 | Borchard et al. | 51/295 |
| 3,997,302 | * | 12/1976 | Supkis | 51/295 |
| 4,078,340 | | 3/1978 | Klecker et al. | 51/295 |
| 4,093,440 | | 6/1978 | Denninger et al. | 71/65 |
| 4,111,666 | | 9/1978 | Kalbow | 51/295 |
| 4,142,334 | | 3/1979 | Kirsch et al. | 51/295 |
| 4,155,721 | * | 5/1979 | Fletcher | 51/295 |
| 4,255,164 | | 3/1981 | Butzke et al. | 51/295 |
| 4,311,489 | | 1/1982 | Kressner | 51/298 |
| 4,381,188 | | 4/1983 | Waizer et al. | 51/298 |

(List continued on next page.)

FOREIGN PATENT DOCUMENTS

| | | | |
|---|---|---|---|
| 26 50 942 | 5/1978 | (DE) . | |
| 2 068 275 | 8/1981 | (DE) . | |
| 195 80 280 | 6/1996 | (DE) | B24D/11/00 |
| 0 552 698 | 7/1993 | (EP) . | |
| 0 554 668 | 8/1993 | (EP) . | |
| 0 623 424 | 11/1994 | (EP) . | |
| 2 294 773 | 12/1987 | (FR) | B23D/61/18 |
| 2 043 501 | 10/1980 | (GB) | B24D/11/00 |
| 2 280 142 | 1/1995 | (GB) | B29C/67/24 |
| 7-156070 | 6/1995 | (JP) | B24D/11/00 |
| WO 92/05915 | 4/1992 | (WO) | B24D/11/00 |
| WO 94/02562 | 2/1994 | (WO) | C09K/3/14 |
| WO 95/20469 | 8/1995 | (WO) | B24D/3/34 |
| WO 95/24991 | 9/1995 | (WO) | B24D/3/34 |
| WO 98 10896 | 3/1998 | (WO) . | |
| WO 98 30358 | 7/1998 | (WO) . | |
| WO 98/30361 | 7/1998 | (WO) . | |

OTHER PUBLICATIONS

Patent Abstracts of Japan, vol. 010, No. 249 (M–511), Aug. 27, 1986 & JP 61 079576 A (Kouyoushiya:KK), Apr. 23, 1986.

Patent Abstracts of Japan vol. 097, No. 011, Nov. 28, 1997 & JP 09 193021 A (Showa Gomme KK: Tokyo Daiyamondo Kogu Seisakusho:KK; Mayekawa MFG Co Lt) Jul. 29, 1997.

*Primary Examiner*—David A. Scherbel
*Assistant Examiner*—Anthony Ojini

(57) ABSTRACT

An abrasive article including (i) an embossed isolation layer defining inversely contoured first and second surfaces with a plurality of peaks on the first surface producing a plurality of pockets on the second surface, (ii) grinding aid-containing protrusions positioned within the pockets, and (iii) a coating of abrasive particles adhered to the contoured first surface of the isolation layer.

20 Claims, 2 Drawing Sheets

U.S. PATENT DOCUMENTS

| | | | | |
|---|---|---|---|---|
| 4,652,275 | | 3/1987 | Bloecher et al. | 51/298 |
| 4,799,939 | | 1/1989 | Bloecher et al. | 51/293 |
| 4,903,440 | | 2/1990 | Larson et al. | 51/298 |
| 5,011,513 | * | 4/1991 | Zador et al. | 51/295 |
| 5,015,266 | | 5/1991 | Yamamoto | 51/293 |
| 5,077,870 | | 1/1992 | Melbye et al. | 24/452 |
| 5,078,753 | | 1/1992 | Broberg et al. | 51/298 |
| 5,174,795 | | 12/1992 | Wiand | 51/295 |
| 5,190,568 | | 3/1993 | Tselesin | 51/293 |
| 5,219,462 | | 6/1993 | Bruxvoort et al. | 51/293 |
| 5,232,470 | | 8/1993 | Wiand | 51/295 |
| 5,233,794 | | 8/1993 | Kikutani et al. | 51/206 |
| 5,316,812 | | 5/1994 | Stout et al. | 428/64 |
| 5,355,636 | * | 10/1994 | Harmon | 51/297 X |
| 5,378,251 | | 1/1995 | Culler et al. | 51/295 |
| 5,435,816 | | 7/1995 | Spurgeon et al. | 51/295 |
| 5,437,754 | | 8/1995 | Calhoun | 156/231 |
| 5,454,750 | | 10/1995 | Cosmano et al. | 451/526 |
| 5,490,878 | * | 2/1996 | Peterson et al. | 51/297 X |
| 5,500,273 | | 3/1996 | Holmes et al. | 428/147 |
| 5,505,747 | | 4/1996 | Chesley et al. | 51/297 |
| 5,551,959 | * | 9/1996 | Martin et al. | 51/295 |
| 5,560,753 | * | 10/1996 | Schnabel et al. | 51/297 X |
| 5,578,098 | | 11/1996 | Gagliardi et al. | 51/295 |
| 5,609,706 | | 3/1997 | Benedict et al. | 156/137 |
| 5,658,184 | | 8/1997 | Hoopman et al. | 451/28 |
| 5,681,217 | | 10/1997 | Hoopman et al. | 451/528 |
| 5,834,109 | * | 11/1998 | Follett et al. | 51/295 X |
| B1 5,190,568 | | 3/1996 | Tselesin | 51/293 |

* cited by examiner

ABRASIVE ARTICLE WITH EMBOSSED ISOLATION LAYER AND METHODS OF MAKING AND USING

FIELD OF THE INVENTION

This invention relates to abrasive articles and methods of making and using abrasive articles. More specifically, this invention relates to abrasive articles incorporating a grinding aid and methods of making and using such abrasive articles.

BACKGROUND OF THE INVENTION

Abrasive articles are used to abrade and finish a variety of workpieces ranging from high pressure metal grinding to the fine polishing of silicon wafers. In general, abrasive articles comprise a plurality of abrasive particles bonded to each other (e.g., a bonded abrasive or grinding wheel) or bonded to a backing (e.g., a coated abrasive sheet). Coated abrasives commonly include the sequential layers of backing, make coat, abrasive particles and size coat. The coated abrasive can further include an optional supersize coat over the size coat. Typically, the coated abrasives include a single layer of abrasive particles and a grinding aid incorporated into one of the layers (e.g., $KBF_4$ incorporated into the supersize coat) for purposes of increasing abrasion efficiency. Once the layer of abrasive particles are worn, the coated abrasive is spent and must be replaced. The industry is continuously seeking ways to extend the useful life of an abrasive article and/or increase the cutting rate of the abrasive article.

One attempt to extend the useful life of coated abrasives is described in U.S. Pat. Nos. 4,652,275; 4,799,939 and 5,039,311. The coated abrasives disclosed in these patents comprise a plurality of abrasive agglomerates bonded onto the upper surface of a backing, wherein the abrasive agglomerates are shaped masses of abrasive grains held together by a binder and optionally including a grinding aid and/or other additives.

Another attempt to extend the usefull life of coated abrasives is described in U.S. Pat. Nos. 4,644,703, 4,773, 920, 5,015,266 and 5,378,251, wherein an abrasive slurry comprising abrasive particles and a binder are bonded to a backing so as to form a lapping film.

These lapping films enjoy wide commercial success in polishing applications where a fine surface finish is desired. However, due to the limited rate of cut attainable with such lapping films, such films have enjoyed only limited success in many other applications.

Culler et al (U.S. Pat. No. 5,378,251) discloses an abrasive article comprising an abrasive slurry bonded to the front surface of a backing wherein the abrasive coating is a homogeneous mixture of abrasive particles, grinding aid and binder. Culler et al. discloses that the abrasive coating may be shaped to provide separate abrasive composites extending from the front surface of the abrasive article.

Tselesin (U.S. Pat. No. 5,190,568) discloses an abrasive article having a contoured front surface produced by coating a contoured backing with an abrasive slurry. Tselesin requires the backing to be constructed from a material which will wear quickly and be promptly removed from contact with a workpiece in order to avoid potentially deleterious contact between the backing and the workpiece.

Several different techniques have been developed for incorporating a grinding aid into a coated abrasive. It is a common practice to incorporate a grinding aid into the size coat and/or the super size coat used in the manufacture of coated abrasives.

Broberg et al. (U.S. Pat. No. 5,078,753) discloses an abrasive article containing erodible agglomerates of a resinous binder and an inorganic filler, such as cryolite, interspersed with abrasive particles. One of the embodiments disclosed by Broberg et al. includes erodible agglomerates positioned between elongated abrasive particles, wherein the erodible agglomerates and the abrasive particles are of substantially the same size.

Cosmano et al. (U.S. Pat. No. 5,454,750) discloses an abrasive article containing erodible agglomerates of a grinding aid or a combination of grinding aid and binder interspersed with the abrasive particles.

Gagliardi et al. (U.S. Pat. No. 5,578,098) discloses an abrasive article containing erodible agglomerates of a grinding aid or a combination of grinding aid and binder interspersed with the abrasive particles. One of the embodiments disclosed by Gagliardi et al. includes rod shaped agglomerates positioned between abrasive particles wherein the erodible agglomerates and the abrasive particles are of substantially the same size (i.e., ratio of maximum dimension of erodible agglomerates to maximum dimension of abrasive particles is between about 2.5:1 to about 0.5:1).

While such techniques are generally effective for incorporating effective amounts of a grinding aid into a coated abrasive, the search continues for improved techniques of incorporating a grinding aid into a coated abrasive.

SUMMARY OF THE INVENTION

We have discovered an abrasive article having an extended useful life span effective for providing abrasion enhancing amounts of a grinding aid to the surface of the workpiece being abraded. The abrasive article further provides an isolation layer between the grinding aid and the abrasive coating (i.e., make coat, abrasive particles, size coat and supersize coat), thereby permitting the use of incompatible materials in the grinding aid and abrasive coating layers.

The abrasive article includes (i) an embossed isolation layer defining inversely contoured first and second surfaces with a plurality of peaks on the first surface producing a plurality of pockets on the second surface, (ii) grinding aid-containing protrusions positioned within the pockets, and (iii) a coating of abrasive particles adhered to the contoured first surface of the isolation layer. The protrusions will generally adhere to the second surface of the isolation layer such that a backing may be provided over the second surface of the isolation layer, but is not required.

The coating of abrasive particles at the peaks formed in the isolation layer have a limited thickness such that initial use of the abrasive article wears away the coating of abrasive particles at the peaks, along with the isolation layer forming the peak, and thereby exposes the grinding aid-containing protrusions to a workpiece.

In an alternative description of the invention, the abrasive article includes (i) an embossed isolation layer defining inversely contoured first and second surfaces with the first surface having (A) a plurality of peaks defining protrusion apexes and producing a plurality of pockets on the second surface, and (B) a plurality of valleys between the peaks defining base layer nadirs, (ii) grinding aid-containing protrusions positioned within the pockets, and (iii) a coating of abrasive particles adhered to the contoured first surface of the isolation layer and defining (A) abrasive coated peaks having an abrasive coated apex, and (B) abrasive coated valleys having an abrasive coated nadir, wherein the protrusion apex of a majority of the protrusions extend above at least one adjoining abrasive coated nadir.

The invention further includes a method of making the abrasive article involving the steps of (1) embossing the isolation layer to form the pockets, (2) filling the pockets with a grinding aid-containing composition to form the protrusions, and (3) coating the abrasive particles onto the contoured first surface of the isolation layer.

The invention also includes a process for abrading a workpiece with the abrasive article involving the steps of obtaining a workpiece in need of abrasion, and abrading the workpiece with the abrasive article.

DETAILED DESCRIPTION OF THE INVENTION

INCLUDING A BEST MODE

DEFINITIONS

Figure 1:
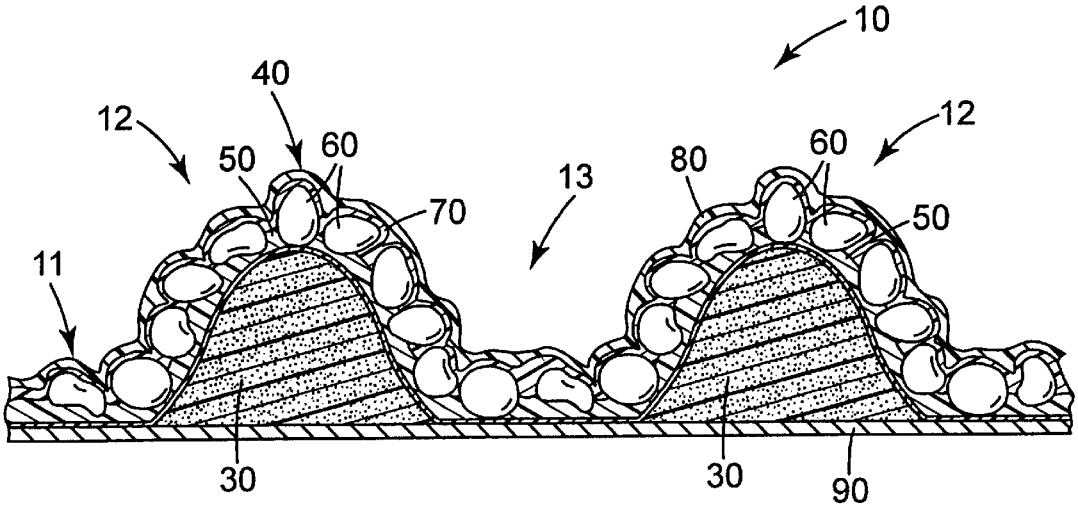
FIG. 1 is a cross-sectional side view of one embodiment of the invention.

As utilized herein, including the claims, the term "abrade" and "abrading" mean to remove material from a workpiece, typically a surface layer of the workpiece, for purposes of grinding a surface of a workpiece so as to effect a change in a dimension of the workpiece, deburring the workpiece, smoothing and polishing a surface of the workpiece, roughing or texturing the surface of a workpiece, and/or cleaning a surface of the workpiece, by forcefully contacting the workpiece with an abrasive article and moving the abrasive article and the workpiece relative to one another.

As utilized herein, including the claims, the term "abrasive particle" refers to particles capable of abrading the surface of a workpiece and includes both (i) individual abrasive particles, and (ii) multiple abrasive particles bonded together with a binder to form abrasive agglomerates such as described in U.S. Pat. Nos. 4,311,489; 4,652,275 and 4,799,939. Abrasive particles useful in the abrasive articles of this invention typically have a Moh's hardness of at least 7.

As utilized herein, including the claims, the term "binder precursor" refers to compositions which can be mixed with solid particulate (e.g., abrasive particles or particles of a grinding aid) and then solidified. Binder precursors include precursors capable of forming thermoplastic or thermosetting resins, with a preference for crosslinked thermosetting resins. Typical binder precursors are liquids under ambient conditions, with a mixture of binder precursor and solid particulates capable of being coated onto a backing. Typical binder precursors are cured by exposing the binder precursor to thermal energy or radiation energy, such as electron beam, ultraviolet light or visible light.

As utilized herein, including the claims, the term "grinding aid" refers to nonabrasive materials capable of improving the abrasion performance of an abrasive article upon a metal workpiece when incorporated into the abrasive coating. Specifically, grinding aids tend to increase the grinding efficiency or cut rate (i.e., the weight of a metal workpiece removed per weight of abrasive article lost) of an abrasive article upon a metal workpiece.

As utilized herein, including the claims, the phrase "consisting essentially of a grinding aid" refers to a nonabrasive composition effective as a grinding aid (i.e., effective for increasing the grinding efficiency or cut rate of an abrasive article) and includes compositions comprised of at least one grinding aid material and optionally one or more additives such as a binder, a diluent, a naturally occurring impurity, etc.

As utilized herein, including the claims, the phrase "initial use," when used to describe the extent to which an abrasive article is used, means the first 10% of the useful life of the abrasive article (e.g., first 100 grams of material removed from workpieces by an abrasive article when a total of 1,000 grams of material can be removed from such workpieces under the same operating conditions before the abrasive article must be replaced).

NOMENCLATURE

10 Abrasive Article (Coated Abrasive)
11 Contoured First Surface of Abrasive Article
12 Peaks
13 Valleys
20 Isolation Layer
21 First Surface of the Isolation Layer
22 Second Surface of the Isolation Layer
25 Pockets
30 Protrusions
30*a* Apex of Protrusions
40 Abrasive Coating
50 Make Coat
60 Abrasive Particles
61*a* Apex of Abrasive Coated Protrusions
61*b* Nadir of Abrasive Coated Isolation Layer
70 Size Coat
80 Supersize Coat
90 Backing
91 First Surface of the Backing
92 Second Surface of the Backing

ABRASIVE ARTICLE

The abrasive articles 10 of this invention include an embossed isolation layer 20, protrusions 30 containing a grinding aid in contact with the second surface 22 of the isolation layer 20, and an abrasive coating 40 over the contoured first surface 21 of the isolation layer 20. The abrasive coating 40 includes abrasive particles 60 bonded to the isolation layer 20 by a make coat 50, and a size coat 70. The abrasive coating 40 optionally includes a supersize coat 80 over the size coat 70 and/or a backing 90 adhered to the second surface 22 of the isolation layer 20. The abrasive coating 40 covers the contoured first surface 21 of the isolation layer 20 with a coating of abrasive particles 60 so as to result in an abrasive article 10 having a contoured first surface 11 with a plurality of peaks 12 and valleys 13.

Isolation Layer

The isolation layer 20 separates the grinding aid containing protrusions 30 formed within the pockets 25 in the isolation layer 20 from the abrasive coating 40 (i.e., the make coat 50, abrasive particles 60, size coat 70 and supersize coat 80) applied to the second surface 22 of the isolation layer 20. Isolation of these materials from each other by the isolation layer 20 prevents adverse chemical interactions between the grinding aid containing protrusions 30 and the abrasive coating 40. A variety of adverse interactions have been observed when certain grinding aid materials are placed in prolonged contact with certain adhesive coatings, including specifically, but not exclusively, (i) precipitation of resin from the make coat, size coat and/or supersize coat, (ii) coagulation of the make coat, size coat and/or supersize coat, (iii) premature curing of the make coat, size coat and/or supersize coat contacted with such (iv) inhibition and/or interference with the formation of a good bond between the abrasive particles and the backing, (v) hydration of hygroscopic constituents in the grinding aid and/or abrasive coating, (vi) hardening, softening, toughening, or weakening of the abrasive article, and/or (vii) discoloring of the abrasive article.

The isolation layer 20 has a first surface 21 and a second surface 22 and can be selected from a wide array of materials capable of being embossed, including conventional abrasive backing materials. Examples of materials suitable for use as the isolation layer 20 include polymeric films, thin metal films, primed polymeric films, nonwovens, and combinations thereof. Other materials may also be used so long as the material is chemically compatible with the other constituents of the abrasive article 10, thermally stable at those temperatures typically encountered during use of the abrasive article 10, and is capable of being embossed. Examples of materials suitable for use as the isolation layer 20 include specifically, but not exclusively, polymeric films of polyethylene, polypropylene, polyester, polyimide and polyvinyl chloride.

The desired thickness of the isolation layer 20 depends upon several factors, including the specific type of material from which the isolation layer 20 is constructed. By way of example, polymeric isolation layers 20 may conveniently range in thickness from 10 to 1000 microns, preferrably 20 to 500 microns, most preferably 25 to 250 microns.

The isolation layer 20 may optionally be treated for purposes of sealing the isolation layer 20 and/or modifying a physical property or characteristic of the isolation layer. Such treatments, as they relate to conventional backings, are well known in the art.

Protrusions

Protrusions 30, containing a grinding aid and preferably consisting essentially of a grinding aid, are positioned within pockets 25 formed in the isolation layer 20. The pockets 25 are open and accessible from the second surface 22 of the isolation layer 20 and can be readily filled with a grinding aid-containing composition to form the protrusions 30. The protrusions 30 present grinding aid to the working surface of the abrasive article 10 throughout the normal usefull life of the abrasive article 10 once the abrasive coating 40 over the peaks 12 on the first surface 21 of the isolation layer 20 is removed (typically occurring within the first several second of use due to the limited surface area of the abrasive article 10 actually contacting the workpiece (not shown)).

Grinding aids are generally believed to improve the abrasion performance of an abrasive article by (i) decreasing friction between the abrasive particles and the workpiece being abraded, (ii) preventing capping of the abrasive particles (i.e., preventing particles removed from the workpiece from being welded to the tops of the abrasive particles), (iii) decreasing the interface temperature between the abrasive particles and the workpiece, (iv) decreasing the grinding force required to abrade the workpiece, and/or (v) oxidizing metal workpieces. In addition to improving the abrasion performance of an abrasive article, the incorporation of a grinding aid often increases the useful life of the abrasive article.

The protrusions 30 contain a grinding aid, with the protrusions 30 preferably formed from grinding aid alone or as a combination of a grinding aid and a binder. In either form, the protrusions 30 may incorporate other additives that do not adversely affect the erodibility and/or grinding aid functionality of the composition, such as coupling agents, wetting agents, fillers, surfactants, dyes and pigments. Representative examples of organic fillers include wood pulp and wood flour. Representative examples of inorganic fillers include calcium carbonate, calcium metasilicate, silica, fiberglass fibers and glass bubbles. The protrusions 30 specifically exclude any abrasive particles.

Grinding aids useful in the invention encompass a wide variety of different materials including both organic and inorganic compounds. A sampling of chemical compounds effective as grinding aids include waxes, organic halide compounds, halide salts, metals and metal alloys.

Specific waxes effective as a grinding aid include specifically, but not exclusively, the halogenated waxes tetrachloronaphthalene and pentachloronaphthalene. Other effective grinding aids include halogenated thermoplastics, sulfonated thermoplastics, waxes, halogenated waxes, sulfonated waxes, and mixtures thereof.

Other organic materials effective as a grinding aid include specifically, but not a exclusively, polyvinylchloride and polyvinylidene chloride.

Examples of halide salts generally effective as a grinding aid include sodium chloride, potassium cryolite, sodium cryolite, ammonium cryolite, potassium tetrafluoroborate, sodium tetrafluoroborate, silicon fluorides, potassium chloride, and magnesium chloride. Halide salts employed as a grinding aid typically have an average particle size of less than 100 $\mu$m, with particles of less than 25 $\mu$m preferred.

Examples of metals generally effective as a grinding aid include, antimony, bismuth, cadmium, cobalt, iron, lead, tin and titanium.

Other commonly used grinding aids include sulfur, organic sulfur compounds, graphite and metallic sulfides. Combinations of these grinding aids can also be employed.

Binders suitable for use in the grinding aid protrusions 30 include a wide range of both organic and inorganic materials. Examples of inorganic binders include cement, calcium oxide, clay, silica, and magnesium oxide. Examples of organic binders include waxes, phenolic resins, urea-formaldehyde resins, urethane resins, acrylate resins, aminoplast resins, glue, polyvinyl alcohol, epoxy resins, and combinations thereof.

When the protrusions 30 are formulated with a binder, the percentage of grinding aid in the protrusions 30 should be between about 5 to 90 wt %, preferably between about 60 to 90 wt %. The remainder of the protrusions 30 composed of binder and optional additives. When the protrusions 30 are formulated with binder, the protrusions 30 should include at least about 1 wt % binder, preferably about 5 to 10 wt % binder.

Grinding aid protrusions 30 including a binder can be conveniently made by (i) mixing the grinding aid and any optional components into the binder precursor until a homogeneous blend is obtained, (ii) coating the blend onto the desired substrate (e.g., the backing 90 or a production tool (not shown)), and then (iii) solidifying the coated blend by drying and/or curing the blend with heat and/or radiation energy.

The viscosity of the blend should be low enough to allow the blend to fill the pockets 25 in the embossed isolation layer 20. Solidification can generally be effected by either removing solvent from the mixture and/or curing the binder precursor in the blend.

Protrusions 30 including a thermoplastic binder may optionally include any of a number of additives such as a plasticizer, a stabilizer, a flow agent, a processing aid, and the like.

Protrusions 30 formulated without a binder can be conveniently made by (i) dispersing the grinding aid in an appropriate medium, (e.g., water, acetone, n-heptane, etc.), (ii) coating the dispersion onto the isolation layer 20, and then (iii) solidifying the dispersion by drying the dispersion with heat and/or radiation energy.

Abrasive Coating

The abrasive coating 40 includes abrasive particles 60, a make coat 50, and a size coat 70. The abrasive coating 40 optionally includes a supersize coat 80 over the size coat 70. The abrasive coating 40 covers the contoured first surface 21 of the isolation layer 20.

MAKE COAT

A make coat binder composition is coated onto the contoured first surface 21 of the isolation layer 20 to form a make coat 50. The make coat 50 is preferably coated onto the contoured first surface 21 as a make coat precursor composition, after which the abrasive particles 60 are deposited onto the precursor composition and the precursor composition precured in order to secure the make coat precursor composition and adhesive particles 60 in position.

The make coat precursor composition is precured by exposing the precursor composition to an appropriate precuring amount of energy of the type capable of initiating crosslinking and/or polymerization of the precursors. Examples of suitable types of energy effective for curing the types of resins suitable for use as a make coat 50 include thermal energy and radiation energy sources, such as electron beam, ultraviolet light and visible light.

The make coat 50 is typically formed from either a condensation curable thermoset resins or an addition polymerizable thermoset resins. The make coat 50 is preferably comprised of an addition polymerizable thermoset resin as such resins are readily cured by exposure to radiation energy through either a cationic mechanism or a free radical mechanism. Depending upon the specific type of energy used and the specific type of binder precursor employed, a curing agent, initiator, or catalyst may be incorporated onto the binder precursor to facilitate initiation of the crosslinking and/or polymerization process.

Types of polymerizable organic resins typically used as the binder precursor of make coats include phenolic resins, urea-formaldehyde resins, melamine-formaldehyde resins, (meth)acrylated urethanes, (meth)acrylated epoxies, ethylenically unsaturated compounds, aminoplast derivatives having pendant α,β unsaturated carbonyl groups, isocyanurate derivatives having at least one pendant (meth)acrylate group, isocyanate derivatives having at least one pendant (meth)acrylate group, vinyl ethers, epoxy resins, and mixtures and combinations thereof.

Phenolic resins are widely used as the make coat in abrasive articles because of their superior thermal properties, ready availability and relatively low cost. Phenolic resins are generally classified as a resole phenolic resins or a novolac phenolic resins based upon the ratio of formaldehyde to phenol in the resin. Resole phenolic resins have a molar ratio of formaldehyde to phenol of greater than or equal to 1:1, often between 1½:1 to 3:1. Novolac phenolic resins have a molar ratio of formaldehyde to phenol of less than 1:1. Examples of commercially available phenolic resins include DUREZ™ and VARCUM™ available from Occidental Chemicals Corp.; RESINOX™ available from Monsanto; and AEROFENE™ and AEROTAP™ available from Ashland Chemical Co.

Acrylated urethanes useful as the make coat in abrasive articles are the diacrylate esters of hydroxyterminated and isocyanate extended polyesters and polyethers. Examples of commercially available acrylated urethanes include UVITHANE 792™, available from Morton Thiokol Chemical, and CMD 6600™, CMD 8400™, and CMD 8805™, available from Radcure Specialties.

Acrylated epoxies useful as the make coat in abrasive articles include the diacrylate esters of epoxy resins, such as the diacrylate esters of bisphenol A epoxy resin. Examples of commercially available acrylated epoxies include CMD 3500™, CMD 3600™, and CMD 3700™, available from Radcure Specialties.

Preferred ethylenically unsaturated compounds are esters resulting from the reaction of an organic moiety containing an aliphatic monohydroxy or aliphatic polyhydroxy group and an unsaturated carboxylic acid. Suitable unsaturated carboxylic acids include acrylic acid, methacrylic acid, itaconic acid, crotonic acid, isocrotonic acid and maleic acid. The ester reaction product preferably has a molecular weight of less than about 4,000. Representative examples of acrylate-based ethylenically unsaturated compounds include methyl methacrylate, ethyl methacrylate, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate.

Aminoplast resins usefull as the make coat in abrasive articles include those having at least one pendant α,β unsaturated carbonyl group on each molecule or oligomer. Suitable α,β unsaturated carbonyl groups include acrylate, methacrylate and acrylamide type groups. Suitable aminoplast resins include specifically, but not exclusively, N-(hydroxymethyl)acrylimide, N,N'-oxydimethylenebisacrylamide, ortho and para acrylamidomethylated phenol, acrylamidomethylated phenolic novolac, and combinations thereof Such materials are described in detail in U.S. Pat. Nos. 4,903,440 and 5,236,472.

Isocyanurate and isocyanate derivatives usefull as the make coat in abrasive articles include those having at least one pendant acrylate group. Such compounds are described in detail in U.S. Pat. No. 4,652,274. A preferred isocyanurate derivative is a triacrylate of tris(hydroxyethyl) isocyanurate.

Epoxy resins are polymerized by opening the oxirane ring structure C-O-C. Epoxy resins useful as the make coat in abrasive articles include both monomeric and oligomeric epoxy resins. Examples of suitable epoxy resins include 2,2-bis[4-(2,3-epoxypropoxy)-phenyl propane] (diglycidyl ether of bisphenol A) and the commercially available epoxy resins EPON 828™, EPON 1004™, and EPON 1001F™ available from Shell Chemical Co., and DER-331™, DER-332™, and DER-334™ available from Dow Chemical Co. Other suitable epoxy resins include glycidyl ethers of phenol formaldehyde novolac such as DEN431™ and DEN-428™ available from Dow Chemical Co.

When employing a free radically curable resin, it is often desirable to incorporate a free radical curing agent for purposes of initiating crosslinking and/or polymerization of the resin. However, it is noted that when an electron beam source is employed as the energy source, a curing agent is generally not required since electron beams are known to generate free radicals directly from the resin.

Examples of suitable free radical thermal initiators include peroxides, (e.g., benzoyl peroxide), azo compounds, benzophenones and quinones. Examples of suitable photoinitiators (i.e., free radical curing agents activated by ultraviolet or visible light), include specifically, but not exclusively, organic peroxides, azo compounds, quinones, benzophenones, nitroso compounds, acryl halides, hydrozones, mercapto compounds, pyrylium compounds, triacrylimdazoles, bisimidazoles, chloroalkytiazines, benzoin ethers, benzil ketals, thioxanthones, acetophenone derivatives, and mixtures thereof. A variety of photoinitiators activated by visible light are described in detail in U.S. Pat. No. 4,735,632. A widely used photoinitiator is IRGACURE 369™ available from Ciba Geigy Corporation.

The make coat 50 can optionally include other conventional components in combination with the binder, such as coupling agents, wetting agents, fillers, surfactants, dyes and pigments.

ABRASIVE PARTICLES

Abrasive particles 60 used in the manufacture of abrasive articles typically have a particle size ranging from about 0.1–2,500 $\mu$m, usually between about 10 to 700 $\mu$m. The abrasive particles 60 should have a Mohs' hardness of at least 7, preferably at least 8. Examples of suitable abrasive particles 60 include particles of alumina zirconia, fused aluminum oxide(including brown aluminum oxide, heat treated aluminum oxide and white aluminum oxide), ceramic aluminum oxide, boron carbide, ceria, chromia, cubic boron nitride, diamond, garnet, iron oxide, silicon carbide (including green silicon carbide), silicon nitride coated silicon carbide, tungsten carbide, and mixtures thereof A detailed discussion of suitable ceramic aluminum oxide particles can be found in U.S. Pat. Nos. 4,314,827, 4,623,364, 4,744,802, and 4,881,951.

The abrasive particles 60 may optionally be coated with a surface coating (not shown) prior to being incorporated into the abrasive article 10. Such surface coatings are used to modifying some property or characteristic of the abrasive particle 60. For example, the abrasive particles 60 may be coated with a surface coating effective for increasing adhesion of the abrasive particles 60 to the make coat 50, or a surface coating effective for altering the abrading characteristics of the abrasive particle 60. Exemplary surface coatings include coupling agents, halide salts, metal oxides such as silica, refractory metal nitrides, refractory metal carbides, and the like.

The abrasive composite may optionally include diluent particles (not shown) interspersed within the abrasive particles 60 to achieve a desired loading of abrasive particles on the abrasive article 10. Such diluent particles typically have a particle size on the same order of magnitude as the abrasive particles 60. Examples of such diluent particles include aluminum silicate, flint, glass beads, glass bubbles, gypsum, limestone, marble, silica, and the like.

OPTIONAL SIZE COAT

The abrasive article 10 can optionally include a size coat 70 coated over the abrasive particles 60 embedded within the make coat 50 on the contoured first surface 21 of the base layer 20. As with the make coat 50, the size coat 70 is preferably coated over the abrasive particles 60 as a liquid binder precursor. The size coat 70 is then either precured in preparation for the addition of a supersize coat 80 over the size coat 70, or fully cured, along with the make coat 50, when a supersize coat 80 will not be added to the abrasive article 10.

The size coat precursor can be precured or fully cured by exposing the size coat precursor to the appropriate amount of energy selected from those types of energy capable of crosslinking and/or polymerizing the binder precursors. Examples of suitable types of energy include thermal energy and radiation energy sources, such as electron beam, ultraviolet light and visible light.

The size coat 70 is typically formed from the same condensation curable thermoset resins and addition polymerizable thermoset resins suitable for use as the make coat 50. As with the make coat 50, the size coat 70 can optionally include other conventional components in combination with the binder, such as coupling agents, wetting agents, fillers, surfactants, dyes and pigments. The size coat 70 can also optionally include a grinding aid.

OPTIONAL SUPERSIZE COAT

The abrasive article 10 can further optionally include a supersize coat 80 coated over the size coat 70. As with the size coat 70, the supersize coat 80 is preferably coated onto the size coat 70 as a liquid binder precursor. The size coat 70 is then fully cured, along with the precured size coat 70 and precured make coat 50, to complete the abrasive article 10.

The supersize coat precursor can be fully cured by exposing the supersize coat precursor to an appropriate amount of energy selected from those types of energy capable of crosslinking and/or polymerizing the binder precursors. Examples of suitable types of energy include thermal energy and radiation energy, such as electron beam, ultraviolet light and visible light.

The supersize coat 80 is typically formed from the same condensation curable thermoset resins and addition polymerizable thermoset resins suitable for use as the make coat 50 and size coat 70. As with the make coat 50 and size coat 70, the supersize coat 80 can optionally include other conventional components in combination with the binder, such as coupling agents, wetting agents, fillers, surfactants, dyes and pigments. The supersize coat 80 can also optionally include a grinding aid.

Optional Backing

The abrasive article 10 can optionally include a backing 90 attached to the second surface 22 of the base layer 20. The backing 90 can be selected from any conventional abrasive backing material having sufficient structural integrity to withstand the abrading process. Examples of useful backings 90 include polymeric films, primed polymeric films, cloth, paper, vulcanized fiber, fibrous sheets, nonwovens, and combinations thereof A preferred backing 90 is a treated cloth backing, such as a phenolic/latex treated cloth or cloth treated with other thermosetting resins. Other useful backings include fiber reinforced thermoplastic backings as disclosed in U.S. Pat. No. 5,316,812 and the endless and seamless backings disclosed in U.S. Pat. No. 5,609,706. The backing 90 may optionally be treated for purposes of sealing the backing and/or modifying a physical property or characteristic of the backing. Such treatments are well known in the art.

The backing 90 may be constructed with an attachment means (not shown) on its second surface 92 for purposes of securing the abrasive article 10 to a support pad (not shown) or back-up pad (not shown). Conventional attachment means include pressure sensitive adhesives, hook and loop attachment systems, and threaded projections such as disclosed in U.S. Pat. No. 5,316,812. Alternatively, the intermeshing attachment system described in U.S. Pat. No. 5,201,101 can be employed.

METHOD OF MANUFACTURE

Figure 2:
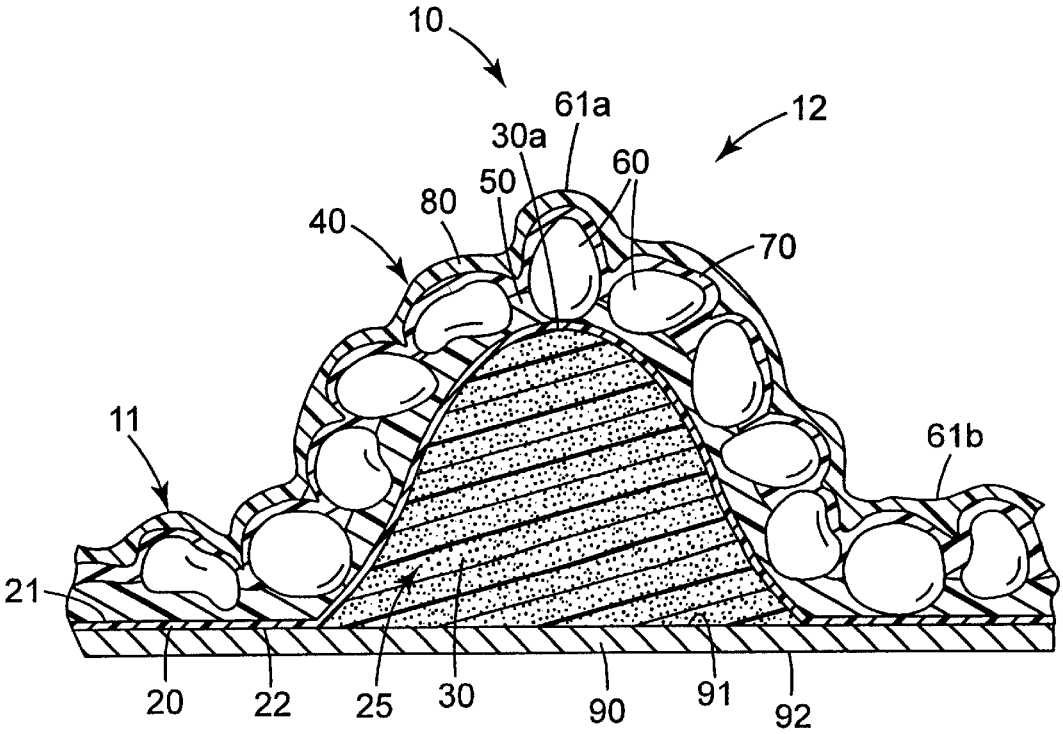
FIG. 2 is an enlarged view of a portion of the invention as shown in FIG. 1.
Figure 3:
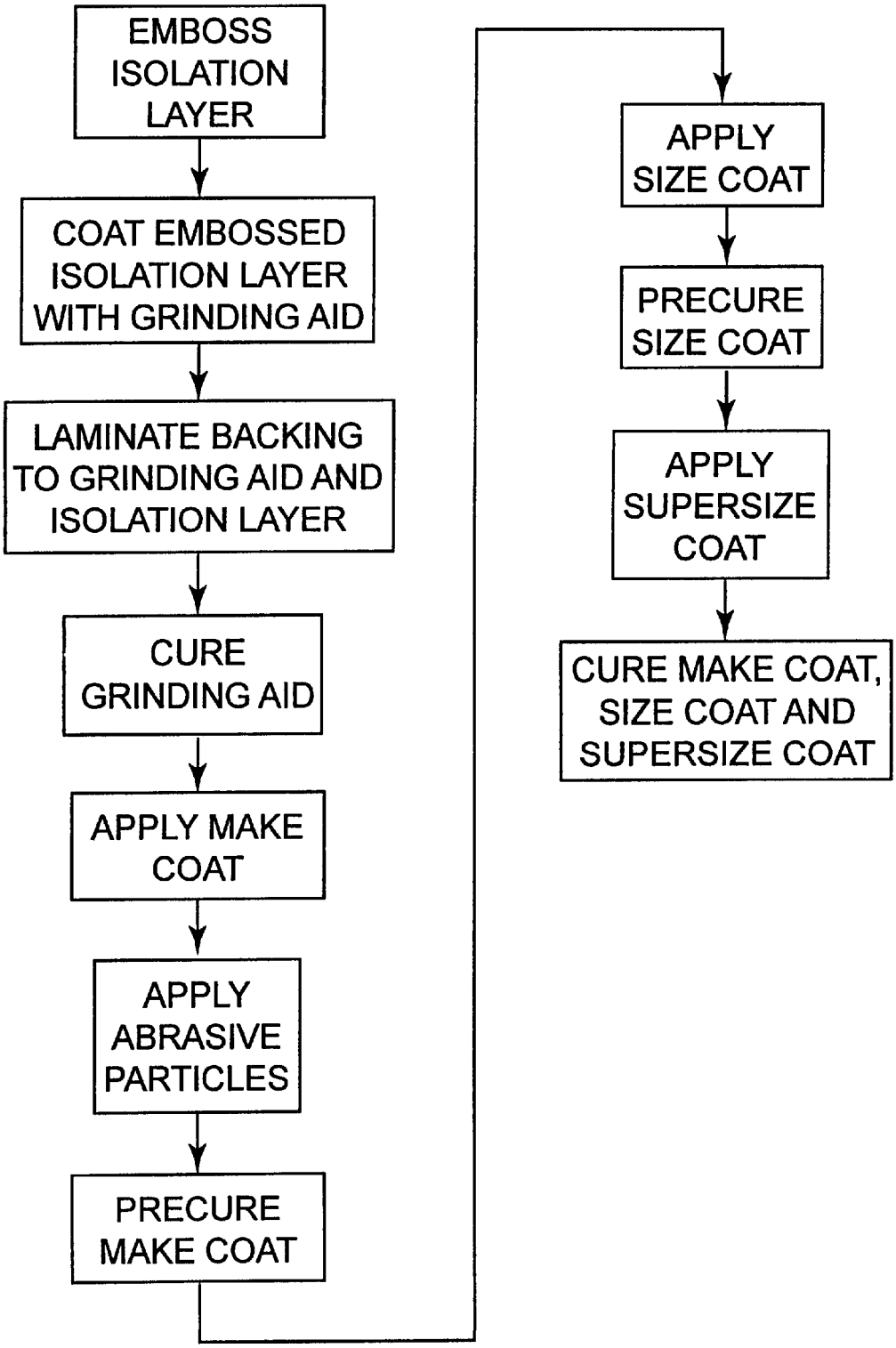
FIG. 3 is a schematic diagram of a method of manufacturing the embodiment of the invention shown in FIG. 1.

The embodiment of the coated abrasive article 10, shown in FIGS. 1 and 2, can be conveniently made by (i) embossing the isolation layer 20 so as to produce a male/female embossed isolation layer 20 having a first male-embossed surface 21 and a second female-embossed surface 22 with pockets 25 accessible from the second surface 22 of the isolation layer and forming peaks 12 on the first surface 21 of the isolation layer 20, (ii) coating the second surface 22 with a composition containing a grinding aid and optionally a binder, so as to at least substantially fill the pockets 25 with the composition, (iii) solidifying the composition coated onto the isolation layer 20 by cooling or curing the composition so as to create grinding aid-containing protrusions 30 within the pockets 25, (iv) applying an appropriate binder precursor to the first surface 21 of the isolation layer 20 to form make coat 50, (v) electrostatically coating or drop coating a multiplicity of abrasive particles 60 onto the make coat 50, (vi) precuring the make coat 50 by subjecting the make coat 50 to thermal and/or radiation energy, (vii) applying an appropriate binder precursor over the abrasive particle 60 containing make coat 50 to form size coat 70, and then (viii) fully curing both the make coat 50 and the size coat 70 by subjecting the make coat 50 and size coat 70 to sufficient thermal and/or radiation energy. Optionally, an appropriate binder precursor can be coated over the size coated abrasive particle 60 and cured by the application of sufficient thermal and/or radiation energy to form a fully cured supersize coat 80.

The protrusions 30 can have substantially any desired shape, including such geometric shapes as cubes, circular cylinders, cones, frustums of a cone, pyramids, frustums of a pyramid, rectangular parallelepipeds, spherical sectors, tetrahedrons, etc.

For most practical applications, the protrusions 30 are preferably sized and shaped with (i) a height of between about 0.1 nm to about 20 mm, preferably between about 1 mm to about 5 mm, and (ii) a horizontal cross-sectional area of between about 0.03 $mm^2$ to about 50 $mm^2$, preferably about 0.4 $mm^2$ to about 20 $mm^2$.

The protrusions 30 should be sized relative to the size of the abrasive particles 60 such that the ratio of the height of the protrusions 30 relative to the longest linear dimension of the abrasive particles 60 is between about 1:10 to about 10:1, preferably between about 0.5:1 to about 10:1.

In a preferred embodiment, the height of the protrusions 30 and the thickness of the abrasive coating 40 are such that the apex 30*a* of a majority of the protrusions 30, (i.e., the height of the protrusion 30 alone, ignoring the thickness of any abrasive coating 40 over the apex 30*a* of the protrusion 30), extends a distance of about 1 $\mu$m to about 100 $\mu$m above at least one adjoining abrasive coated nadir 61*b* (i.e., the height of the nadir 61*b* including the thickness of the abrasive coating 40 filling the nadir 61*b*).

Energy Source

The types of energy suitable for use in curing the binder in the grinding aid, abrasive coating 40, make coat 50, size coat 70 and/ or supersize coat 80 include thermal and radiation energy.

The amount of energy required to effect the desired degree of crosslinking and/or polymerization depends upon several factors such as the specific composition to be cured, the thickness of the material, the amount and type of abrasive particles present, and the amount and type of optional additives present. When curing is effected with thermal energy, temperatures between about 30° to 150° C., typically between 40° to 120° C., with an exposure time of from 5 minutes to over 24 hours, are generally effective for curing the coating.

Suitable radiation energy types include electron beam, ultraviolet light, and visible light. Electron beam radiation, which is also known as ionizing radiation, can be used at an energy level of about 0.1 to about 10 Mrad, preferably at an energy level of about 1 to about 10 Mrad. Ultraviolet radiation refers to non-particulate radiation having a wavelength within the range of about 200 to about 400 nanometers, preferably within the range of about 250 to 400 nanometers. Visible radiation refers to non-particulate radiation having a wavelength within the range of about 400 to about 800 nanometers, preferably in the range of about 400 to about 550 nanometers. It is preferred to use 300 to 600 watt/inch visible light.

Certain abrasive articles 10 may need to be humidified and flexed prior to use in accordance with standard conditioning procedures.

The abrasive article 10 can be converted into any desired form such as a cone, endless belt, sheet, disc, etc.

PROCESS OF USING

The abrasive article 10 is typically used by bringing the abrasive article 10 into frictional contact with a metal workpiece (not shown). The metal workpiece can be any type of metal such as mild steel, stainless steel, titanium, metal alloys, exotic metal alloys and the like. The workpiece may be flat or may have a shape or contour associated with it. Initial use of a new abrasive article 10 to abrade the surface of a workpiece causes the abrasive coating 40 covering the apex 61*a* of the abrasive coated protrusions 30 to quickly wear away due to the limited surface area of the abrasive article 10 in actual contact with the surface of the workpiece (not shown), followed by removal of the exposed isolation layer 20 covering the apex 30*a* of the protrusions 30 so as to provide contact between the grinding-aid containing protrusions 30 and the surface of the workpiece (not shown).

Depending upon the specific application, the force at the abrading interface between the abrasive article 10 and the workpiece can range from about 1 N to over 10,000 N. Generally, the force at the abrading interface ranges from about 10 N to 5,000 N.

Also depending upon the specific application, it may be desirable to provide a lubricating and/or heat transferring liquid between the abrasive article 10 and the workpiece. Common liquids used for this purpose include water, lubricating oils, emulsified organic compounds, cutting fluids, soaps, etc. These liquids may also contain various additives such as defoamers, degreasers, corrosion inhibitors, or the like.

The abrasive article 10 can be used by hand but is preferably mounted upon a machine. At least one, and optionally both, of the abrasive article 10 and the workpiece must be moved relative to the other to effect grinding.

The abrasive article 10 can be converted into a belt, tape roll, disc, sheet, etc., depending upon the desired application. When formed as a belt, the two free ends of the abrasive article 10, formed as a sheet, are joined together and spliced. Endless abrasive belts are typically mounted upon a machine in which the belt traverses an idler roll and a platen or contact wheel. The hardness of the platen or contact wheel is selected to produce the desired application force and rate of cut on the workpiece. In addition, the speed of the abrasive belt relative to the workpiece is selected to effect the desired cut rate and surface finish. Typical abrasive belts range in size from about 5 mm to 1,000 mm wide and from about 5 mm to 10,000 mm long.

Abrasive tapes are simply provided as substantially continuous lengths of abrasive article. Abrasive tapes commonly range in width from about 1 mm to 1,000 mm, generally between 5 mm to 250 mm. Abrasive tapes are usually provided in roll form and used by (i) unwinding the tape from the tape roll, (ii) conveying the unwound tape over a support pad that forces the tape against a workpiece, and then (iii) rewinding the tape. The abrasive tapes can be continuously fed through the abrading interface and can be indexed.

Abrasive discs typically range in size from about 50 mm to 1,000 mm in diameter and are secured to a back-up pad by an attachment means. Abrasive discs are commonly used at rotation speeds of about 100 to 20,000 revolutions per minute, typically about 1,000 to 15,000 revolutions per minute.

EXPERIMENTAL

TESTING PROCEDURES COATED ABRASIVE (BELT)

The coated abrasive article to be tested is converted into an 80 inch (203 cm) long by 2½ inch (6.3 cm) wide continuous belts and installed upon a THOMPSON reciprocating bed grinding machine. The belt is conventionally flexed to controllably break the hard bonding resins and used to grind the upper face of a stainless steel workpiece having a height of 4 inches (10.2 cm), a width of 1 inch (2.54 cm) and a length of 7 inches (17.78 cm). The abrasive belt is run at a speed of 5,600 ft/min (1,707 mrmin) and the table reciprocated relative to the belt at a speed of 100 ft/min (30.5 m/min). The belt is incrementally downed a distance of 30 $\mu$m after each pass of the workpiece. Grinding was carried out dry except that upper surface of the workpiece was flooded with water and blasted with cool air after each pass in order to cool the abraded surface of the workpiece. Each belt was used until it shelled.

The normal force ($F_n$) and horse power requirements are measured for each pass.

PROCEDURE FOR TESTING COATED ABRASIVE (DISC)

The coated abrasive article to be tested is cut into a 7 inch (17.8 cm) diameter disc with a ⅞ inch (2.2 cm) diameter center hole and installed on a conventional slide action testing machine. The disc is conventionally flexed to controllably break the hard bonding resins, mounted on a beveled aluminum back-up pad, and used to grind the upper face of a 1 inch (2.5 cm) by 7 inch (18 cm) stainless steel workpiece resulting in a wear path of about 140 $cm^2$ on the disc. The disc is driven at approximately 5,500 rpm with that portion of the disc overlaying the beveled edge of the back-up pad contacting the workpiece at a weight of 5.91 kg.

The workpiece is weighed before and after an abrading cycle of one minute duration to determine the amount of cut (ie., weight of stainless steel removed from the workpiece). The test is terminated after twelve abrading cycles unless terminated earlier due to excessive wear of the disc as determined by an inability of the disc to remove at least 5 grams of material from the workpiece in a single abrading cycle.

GLOSSARY

The following acronyms, abbreviations, and trade names are used throughout the Examples.

| | DESCRIPTION | |
|---|---|---|
| ACRONYM | Full Name | Trademark and Supplier |
| RESINS | | |
| BPAS | A composition containing a diglycidyl ether of bisphenol A epoxy resin coatable from an organic solvent. The epoxy equivalent weight ranges from about 185 to about 195. | EPON 828 ™ Shell Chemical Company Houston, Texas. |
| BPAW | A composition containing a diglycidyl ether of bisphenol A epoxy resin coatable from water containing approximately 60% solids, 40% water and a nonionic emulsifier. The epoxy equivalent weight ranged from about 600 to about 700. | CMD 35201 ™ Rhone-Poulene, Inc. Louisville, Kentucky |
| RPI | A resole phenolic resin with 75% solids (non-volatile). | |
| CURING AGENT | | |
| PA | A polyamide curing agent. | VERSAMID 125 ™ Henkel Corporation Cincinnati, Ohio |
| EMI | A 100% solids composition of 2-ethyl-4-methyl imidazole. | EMI-24 ™ Air Products Allentown, Pennsylvania |
| GRINDING AID | | |
| $KBF_4$ | Micropulverized potassium tetra-fluoroborate (98% pure). 95 wt % passes through a 325 mesh screen and 100 wt % passes through a 200 mesh screen | |
| CRY | Synthetic Cryolite (trisodium hexafluoroaluminate). | |
| ADDITIVE | | |
| IO | Red iron oxide. | |
| HP | A liquid mixture of 85 wt % 2-methoxy propanal and 15 wt % water. | |
| WC100 | An aromatic hydrocarbon solvent. | WC-100 ™ Worum Chemical Co. St. Paul, Minnesota. |
| DISPERS-ING AGENT | | |
| AOT | Sodium dioctyl sulfosuccinate. | AEROSOL OT ™ Rohm and Haas Company Philadelphia, Pennsylvania |
| ISOLATION LAYER | | |
| ET-N | Male/Female embossed nylon film embossed with tooling of 0.40 inch (10.2 mm) diameter posts on 0.080 inch (2.0 mm) centers. | |
| PVC | Polyvinylcholride film. | |
| ET-PVC | Male/Female embossed Polyvinylchloride film embossed with tooling of 0.40 inch (10.2 mm) diameter posts on 0.080 inch (2.0 mm) centers. | |

EXAMPLES

GENERAL PROCEDURE FOG MAKING COATED ABRASIVES

A dispersion of grinding aid and binder is coated onto the female side of an embossed isolation layer. The coated dispersion is cured by exposure to a suitable energy source. The exposed surface of the cured dispersion is bonded onto a disc or belt through use of a suitable adhesive and cured. The male side of the isolation layer is coated with a make coat composition. Abrasive grains are drop coated onto the make coat and the resulting abrasive article precured. A size coat is applied over the abrasive grains and the partially cured make coat. When a supersize coat is to be added, the size coat is partially cured prior to application of the supersize coat. When a supersize coat is not to be added, the make coat and the size coat are filly cured after application of the size coat. The optional supersize coat, when applied, is applied over the partially cured size coat, and then cured to produce a finally cured abrasive article. The finally cured abrasive article is then optionally flexed and conditioned prior to testing.

COMPARATIVE EXAMPLE A AND B AND EXEMPLARY EXAMPLES 1 AND 2

Comparative abrasive articles A and B and exemplary abrasive articles 1 and 2 were manufactured in accordance with the General Procedure for Making Coated Abrasives described above, and tested in accordance with Testing Procedure (Belt) or Testing Procedure (Disc) as set forth in Tables 1–4 below.

TABLE 1

(Composition of Abrasive Articles)

| | ISOLATION | GRINDING AID | | MAKE COAT | | ABRASIVE GRAINS | | SIZE COAT | | SUPERSIZE COAT | |
|---|---|---|---|---|---|---|---|---|---|---|---|
| DESIGNATION | LAYER Type | Type\ Comp. | Location | Comp | Coat Wt ($g/m^2$) | Type | Coat Wt ($g/m^2$) | Comp | Coat Wt ($g/m^2$) | Comp | Coat Wt ($g/m^2$) |
| Compare A | None | None | N/A | 68% BPAS<br>30% PA<br>02% RD-2 | — | Grade 50 Ceramic $Al_2O_3$ | — | 29% RPI<br>51% CRY<br>18% HP<br>02% IO | — | None | None |
| Example 1 | ET-N | None | N/A | 68% BPAS<br>30% PA<br>02% RD-2 | 248 | Grad 50 Ceramic $Al_2O_3$ | 877 | 29% RPI<br>51% CRY<br>18% HP<br>02% IO | 526 | None | None |
| Compare B (Regalite Polycut YF ™)[1] | — | 29.2% BPAW<br>0.35% EMI<br>53.3% $KBF_4$<br>14.1% H2O<br>0.75% AOT<br>2.3% IO | Female Side of Isolation Layer | — | — | — | — | — | — | — | — |
| Example 2 | ET-PVC | 29.2% BPAW<br>0.35% EMI<br>53.3% $KBF_4$<br>14.1% H2O<br>0.75% AOT<br>2.3% IO | Female Side of Isolation Layer | 40% BPAS<br>18% PA<br>02% RD-2<br>12% WC100<br>28% $CaCO_3$ | 175 | Grade 50 Ceramic $Al_2O_3$ | 790 | 29% RPI<br>51% CRY<br>18% HP<br>02% IO | 351 | None | — |

[1]Grade 50 Regalite Polycut YF ™ resin bond cloth abrasive belt available from Minnesota Mining and Manufacturing Company of St. Paul Minnesota.

TABLE 2

(Curing and Conditioning of Abrasive Articles)

| | MAKE COAT PRECURE CONDITIONS | | SIZE COAT CURE CONDITIONS | | FINAL CURE CONDITIONS | | FINAL CONDITIONING | |
|---|---|---|---|---|---|---|---|---|
| DESIGNATION | Time (min) | Temp (° C.) | Time (hrs) | Temp (° C.) | Time (min) | Temp (° C.) | Time (wks) | RH (%) |
| Compare A | 90 | 90 | 11½ | 90 | 90 | 100 | 1 | 45 |
| Example 1 | 90 | 90 | 11½ | 90 | 90 | 100 | 1 | 45 |
| Compare B | | | | | | | | |
| Example 2 | 90 | 90 | 11½ | 90 | 90 | 100 | | |

TABLE 3

(Testing (Disc) of Abrasive Articles)

| ABRASIVE ARTICLE | TYPE OF STEEL | CUT 1st Cycle (g) | Last Cycle (g) | Total # Cycles | Total Cut (g) | Cut/Cycle (g/cycle) | % of Control |
|---|---|---|---|---|---|---|---|
| Compare A | 1018 Mild Steel | 64 | 43 | | 916 | | |
| Example 1[1] | 1018 Mild Steel | 28 | 47 | | 611 | | |

[1]Pockets in embossed isolation layer were open and exposed after 1st abrading cycle.

TABLE 4

(Testing (Belt) of Abrasive Articles)

| ABRASIVE ARTICLE | TYPE OF STEEL | $F_n$ @ 0.015 $in^3/in^2$ | Horse Power @ 0.015 $in^3/in^2$ |
|---|---|---|---|
| Comparative B | 304 Stainless Steel | 50 | 4.0 |
| Example 2 | 304 Stainless Steel | 69 | 3.9 |

Conclusions

As shown in Table 4, an abrasive belt manufactured in accordance with the present invention (i.e., protrusions of grinding aid separated by an isolation layer from the abrasive coating) can provide an increased cutting efficiency relative to conventional abrasive belts as shown by the ability of the belt of Example 2 to exert a higher normal force relative to the belt of Comparative Example B, at a fixed rate of cut, without requiring an increase in the power used to drive the belt.

We claim:

1. An abrasive article, comprising:

a) an embossed isolation layer defining contoured first and second surfaces with a plurality of peaks on the first surface producing a plurality of pockets on the second surface, b) grinding aid-containing protrusions positioned in the pockets, wherein the grinding aid is selected from the group consisting of halogenated thermoplastics, sulfonated thermoplastics, waxes, halogenated waxes, sulfonated waxes, and mixtures thereof, and c) a coating of abrasive particles adhered to the contoured first surface of the isolation layer.

2. The abrasive article of claim 1, wherein the protrusions are adhered to the second surface of the isolation layer.

3. The abrasive article of claim 1, wherein the protrusions have a top immediately underneath the peaks, and the coating of abrasive particles has a limited thickness covering the peaks such that initial use of the abrasive article wears away the coating of abrasive particles and the isolation layer covering the top of the protrusions so as to allow the protrusions to contact a workpiece.

4. The abrasive article of claim 1, wherein the grinding aid in the protrusions and the abrasive coating are incompatible and the isolation layer is positioned intermediate the protrusions and the abrasive coating so as to prevent direct contact between the protrusions and the abrasive coating prior to use.

5. The abrasive article of claim 1, further comprising a backing sandwiching the protrusions between the backing and the isolation layer.

6. The abrasive article of claim 1, wherein the protrusions consist essentially of a grinding aid.

7. The abrasive article of claim 1, wherein the protrusions are free of abrasive particles.

8. The abrasive article of claim 1, wherein the protrusions are constructed from a material selected from the group consisting of poly(vinyl chloride), polyvinylidene chloride and polyvinylidene fluoride.

9. The abrasive article of claim 1, wherein the protrusions have a horizontal cross-sectional area of between about 0.03 to about 50 $mm^2$.

10. The abrasive article of claim 1, wherein the abrasive coating comprises (i) a make coat adhered to the contoured first surface, (ii) abrasive particles adhered to the make coat, and (iii) a size coat covering the abrasive particles.

11. The abrasive article of claim 1, wherein the protrusions have a height of between about 1 mm to about 5 mm.

12. The abrasive article of claim 1, wherein the shape of the protrusions is selected from the group consisting of a cube, a circular cylinder, a cone, a frustum of a cone, a pyramid, a frustum of a pyramid, a rectangular parallelepiped, a spherical sector, and a tetrahedron.

13. An abrasive article, comprising:

a) an embossed isolation layer defining inversely contoured first and second surfaces with a plurality of peaks on the first surface producing a plurality of pockets on the second surface, b) grinding aid-containing protrusions positioned within the pockets and adhered to the second surface of the isolation layer, wherein the grinding aid is selected from the group consisting of halogenated thermoplastics sulfonated thermoplastics, waxes, halogenated waxes, sulfonated waxes, and mixtures thereof, and wherein the first surface of the isolation layer includes peaks having protrusion apexes and valleys having base layer nadirs, and c) a coating of abrasive particles adhered to the contoured first surface of the isolation layer and defining (i) abrasive coated peaks with each peak having an abrasive coated apex, and (ii) abrasive coated valleys with each abrasive coated valley having an abrasive coated nadir, d) wherein the apex of a majority of the protrusions extend above at least one adjoining abrasive coated nadir.

14. The abrasive article of claim 13, wherein the grinding aid in the protrusions and the abrasive coating are chemically incompatible and the isolation layer is positioned intermediate the protrusions and the abrasive coating so as to prevent direct contact between the protrusions and the abrasive coating prior to use.

15. The abrasive article of claim 13, further comprising a backing sandwiching the protrusions between the backing and the isolation layer.

16. The abrasive article of claim 13, wherein the protrusions consist essentially of a grinding aid.

17. The abrasive article of claim 13, wherein the protrusions are free of abrasive particles.

18. The abrasive article of claim 13, wherein the isolation layer is constructed from a material selected from the group consisting of poly(vinyl chloride), polyvinylidene chloride and polyvinylidene fluoride.

19. The abrasive article of claim 13, wherein the abrasive coating comprises (i) a make coat adhered to the contoured first surface, (ii) abrasive particles adhered to the make coat, and (iii) a size coat covering the abrasive particles.

20. The abrasive article of claim 13, wherein the shape of the protrusions protrusions is selected from the group consisting of a cube, a circular cylinder, a cone, a frustum of a cone, a pyramid, a frustum of a pyramid, a rectangular parallelepiped, a spherical sector, and a tetrahedron.

* * * * *

UNITED STATES PATENT AND TRADEMARK OFFICE

CERTIFICATE OF CORRECTION

PATENT NO. : 6,183,346 B1
DATED : February 6, 2001
INVENTOR(S) : John J. Gagliardi It is certified that error appears in the above-identified patent and that said Letters Patent is hereby corrected as shown below:

Title page,
Item [56], References Cited, U.S. PATENT DOCUMENTS, add -- 4,317,660, 03/1982 --
FOREIGN PATENT DOCUMENTS, "2 294 773" should read -- 2 624 773 --

Column 8,
Line 27, "usefull" should read -- useful --
Line 38, "usefull" should read -- useful --

Column 9,
Line 28, add -- . -- after "thereof"

Column 10,
Line 45, add -- . -- after "thereof"

Column 11,
Line 33, "nm" should read -- mm --

Column 13,
Line 29, "mrmin" should read -- m/min --
Line 31, "downed" should read -- down fed --

Column 16,
Line 1, "filly" should read -- fully --

Signed and Sealed this

Twenty-fifth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,183,346 B1 
DATED : February 6, 2001
INVENTOR(S) : Gagliardi, John J.

It is certified that error appears in the above-identified patent and that said Letters Patent is hereby corrected as shown below:

Title page,
Item [56], FOREIGN PATENT DOCUMENTS, insert -- GB 2043501 10/1980 --; and insert -- GB 2280142 01/1995 --.

Signed and Sealed this

Seventeenth Day of June, 2003

JAMES E. ROGAN
*Director of the United States Patent and Trademark Office*